US006070382A

United States Patent [19]

Ettema

[11] Patent Number: 6,070,382

[45] Date of Patent: Jun. 6, 2000

[54] INSULATED METAL WALL CONSTRUCTION

[75] Inventor: Antonius Marinus Ettema, Herten, Netherlands

[73] Assignee: Rockwool Lapinus B.V., Netherlands

[21] Appl. No.: 08/842,284

[22] Filed: Apr. 23, 1997

[51] Int. Cl.[7] ..... E04B 1/74

[52] U.S. Cl. ..... 52/404.4; 52/787.11; 52/794.1

[58] Field of Search ..... 52/591.4, 592.4, 52/404.4, 794.1, 265, 268, 269, 309.9, 309.14, 787.11

[56] References Cited

U.S. PATENT DOCUMENTS

| | | | |
|---|---|---|---|
| 1,604,079 | 10/1926 | Schwartz | 52/404.4 |
| 2,047,154 | 7/1936 | Pimsner | 52/404.4 X |
| 3,070,196 | 12/1962 | Switzgable, Jr. | 52/404.4 |
| 3,786,609 | 1/1974 | Difazio | 52/309.5 X |
| 3,797,190 | 3/1974 | Widdowson | 52/592.4 |
| 3,935,688 | 2/1976 | Trojahn et al. | 52/794.1 X |
| 3,998,024 | 12/1976 | Frandsen | 52/794.1 X |
| 4,047,346 | 9/1977 | Alderman | 52/749.12 X |
| 4,117,641 | 10/1978 | Wells | 52/404.3 |
| 4,161,567 | 7/1979 | Sturgeon | 52/794.1 X |
| 4,329,827 | 5/1982 | Thorn | 52/730.7 X |
| 4,373,312 | 2/1983 | Kim | 52/537 X |
| 4,428,991 | 1/1984 | Kamstrup-Larsen | 52/404.1 X |
| 4,434,592 | 3/1984 | Reneault et al. | 52/408 X |
| 4,446,664 | 5/1984 | Harkins | 52/404.3 |
| 4,494,348 | 1/1985 | Kastelic | 52/404.4 X |
| 4,575,981 | 3/1986 | Porter | 52/309.9 |
| 4,952,441 | 8/1990 | Bose et al. | 52/407.3 X |
| 5,262,217 | 11/1993 | Blaauw | 52/794.1 X |
| 5,277,011 | 1/1994 | Serrano Martin | 52/309.9 X |
| 5,373,678 | 12/1994 | Hesser | 52/309.9 X |

FOREIGN PATENT DOCUMENTS

| | | |
|---|---|---|
| 9400873 | 1/1996 | Netherlands . |
| 1114008 | 5/1968 | United Kingdom . |

*Primary Examiner*—Carl D. Friedman
*Assistant Examiner*—Timothy B. Kang
*Attorney, Agent, or Firm*—Banner & Witcoff, Ltd.

[57] ABSTRACT

A wall with enhanced fire resistance and thermal insulation is formed from first and second skins manufactured substantially from plate material, wherein insulating material manufactured from mineral wool is arranged between the skins, wherein the first skin is provided with noses arranged at regular distances and facing toward the inside of the wall, pointed connections are arranged between the noses and the second skin and a material strip manufactured from insulating material and dimensioned to absorb pressure forces is placed between the noses and the second skins.

19 Claims, 1 Drawing Sheet

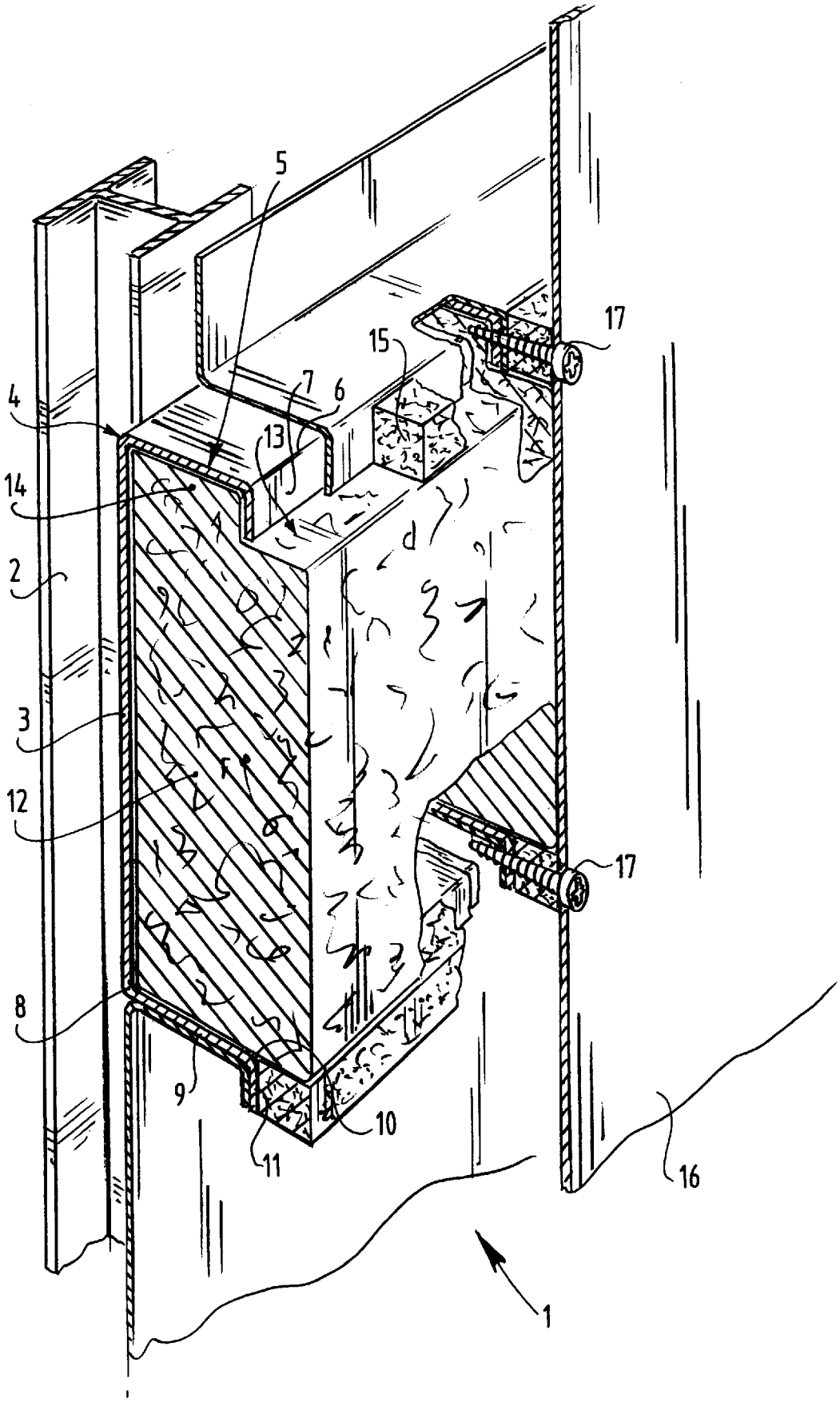
5
17
15
7
6
4
13
14
2
3
12
17
8
9
10
11
16
1

INSULATED METAL WALL CONSTRUCTION

BACKGROUND OF THE INVENTION

The present invention relates to a wall, comprising a first skin manufactured substantially from plate material and a second skin manufactured substantially from plate material, wherein insulating material manufactured from mineral wool is arranged between the skins, wherein the first skin is provided with noses arranged at regular distances and facing toward the inside of the wall and pointed connections are arranged between the noses and the second skin and a material strip manufactured from insulating material and dimensioned to absorb pressure forces is placed between the nose and the second skin.

Such a wall construction is known from the published Netherlands patent application with publication number 94.00873.

In this known wall construction not only is a quantity of insulating material situated between the inner and outer skin but also an open space.

Such an open space is disastrous in terms of the fire resistance of such a wall construction. Such an open space further results in a mediocre insulating value.

SUMMARY OF THE INVENTION

The object of the present invention is to provide such a wall construction, wherein the fire resistance and the thermal insulating value are greatly improved.

This object is achieved in that the space between the first skin and the second skin is wholly filled with insulating material.

As a consequence of these steps the space between the first skin and the second skin of the wall construction is wholly filled with insulating material.

This has the result that the fire resistance of such a construction is greatly improved relative to the prior art. The fire resistance of the wall construction according to the invention is greater than two hours from inside to outside as well as from outside to inside. These are exceptionally high values, taking into account the small thickness of the construction.

For the technical insulating value a surprisingly high value is achieved—for this limited thickness—of about 2.5 $m^2$ K/W.

In addition, the thermal insulation is greatly improved.

According to a first preferred embodiment at least the second skin is smooth.

This has the result that the second skin lies flat against the insulating material which can be embodied in block form. This results in a simple and thus inexpensive embodiment without any loss of quality. It is pointed out herein that it is known from the prior art to use a corrugated skin. In order to comply with the steps of the invention the blocks of insulating material would in such a situation likewise have to be corrugated on one side, which is of course expensive. The embodiment of claim 2 avoids such drawbacks, The invention further relates to a wall element for use in a wall having a plate for forming the first skin which is provided on its first side with a nose which is directed toward the inside of the wall and which is provided on its edge with an inward bent strip extending parallel to the plate, which plate is provided on its second side located opposite the first side with a second inward directed nose, the depth of which is substantially the same as the depth of the first nose and which is provided with a second bent strip which extends parallel to the plate and which is directed outward.

As a result of these steps a wall element is obtained of which the noses and edge strips can be formed from a single plate by a simple forming process. After forming of the plate the insulating element can herein be pushed into the wall element, wherein at least some form of fixation by the inward directed nose takes place on at least one side. This is in contrast to the prior art wherein different plate pieces are used which are evidently joined together after addition of the insulating material, perhaps even on the building site. It will be apparent that this entails logistic difficulties.

Other attractive preferred embodiments can be found in the sub-claims.

BRIEF DESCRIPTION OF THE DRAWINGS

The invention will now be elucidated with reference to the annexed FIG. 1 which shows a perspective, partly broken away view of a wall according to the present invention.

DETAILED DESCRIPTION OF THE INVENTION

Shown in FIG. 1 is a wall construction 1 which is fixed to substantially vertically extending H-profiles 2, such as is generally usual in the construction of factory halls. These H-profiles 2 can be arranged on the inside as well as on the outside of the actual wall 1. Arranged against the H-profiles 2 are profile plates 3, for instance by means of clamps, screw connections, glue connections or other type of connections (not shown in the drawing). Each of the profile plates 3 is bent on a seam 4, thus forming a nose 5, while the nose 5 is bent at a seam 6 to form an edge 7. On the other side the profile plate 3 is bent on a seam 8 to form a complementary nose 9, while the relevant complementary nose 9 is bent on a seam 10 to form an edge 11.

The thus formed profile plates 3 are fixed in mutually adjoining manner against the H-profiles, wherein the complementary noses 9 with the edges 11 mounted thereon engage on the noses 5 and the edges 7 of the underlying plate mounted thereon.

In this construction the noses 5 extend in horizontal direction; it will be apparent that it is likewise possible to turn the plates through 90° so that the seams extend vertically. It is of course even possible to cause the seams to extend at any random angle. From the open sides insulating elements 12 are subsequently placed against the plates 3. The insulating elements 12 are each provided with a rebate 13, so that the breast 14 formed by the rebate 13 engages inside the nose 5. A clamp fitting of insulating elements 12 to the top of the plates 3 is thus obtained. By means of for instance a slight oversize of the insulating elements 12 they are clamped fixedly between nose 5 and complementary nose 9 due to the resilient properties of the relevant material, thus obtaining a good fixing. Material strips 15 are then clamped resting on the rebate 13. This clamping is possible in that the material strips have a large oversize. It is however possible to apply other principles of fixation. As the insulating elements 12, these material strips are manufactured from mineral wool, although from mineral wool of a greater density. This has the advantage that these material strips are suitable for absorbing a pressure force. It is noted herein that the material strips are preferably formed such that the fibres of the mineral wool extend substantially in a direction parallel to the main direction of the wall. It is precisely in this manner that the material is suitable for absorbing pressure forces. It is however also possible to apply material with a different orientation or a different type of material.

Subsequently placed on the thus formed wall constructions are metal plates 16 which are fastened by means of screws 17. The screws 17 herein extend through the material strips 15, but also through the bent edges 7 respectively 11 of the profile plates 3. A good adhesion of the outer plates 16 to the profile plates 3 is hereby obtained, wherein a good mechanical connection is obtained by using the material strips 15 which are suitable for absorbing a pressure force, while the thermal insulating value of the thus formed wall construction is negatively affected to only a very slight degree due to the pointed character of the screw connections 17. This results in a high thermal insulating value and a great fire resistance.

It will be apparent that the thus described embodiment can be varied in diverse ways without deviating from the invention; it is possible for instance to use other fixing methods instead of the screw connections 17, for instance by means of glueing, and it is possible to use different types of plate, for instance with different profile edges. It will be apparent that the plates 3 and 16 also have finite dimensions in horizontal direction, so that provisions must also be made for mutual connection in the horizontal plane.

I claim:

1. A wall comprising a first skin including at least one profile plate manufactured substantially from plate material, said profile plate includes a plurality of noses spaced from each other, each said nose faces toward an inside of the wall, and a medial plate portion positioned between said noses for abutting and extending along a support member; a second skin manufactured substantially from plate material, said second skin extends parallel to the length of said medial plate portion; an insulating material manufactured from mineral wool and arranged between the profile plate of said first skin and said second skin; pointed connectors arranged between the noses and the second skin; and a material strip manufactured from insulating material and positioned between a first one of said noses and the second skin for absorbing pressure forces at a connection between said first one of said noses and said second skin; and wherein the space between the first skin and an inner surface of the second skin is wholly filled with insulating material.

2. A wall as claimed in claim 1, characterized in that at least the second skin is flat.

3. A wall as claimed in claim 2, characterized in that the material strip is manufactured from the same material as the insulating material arranged between said skins but that the density thereof is greater.

4. A wall as claimed in claim 2, characterized in that the connectors are screw connectors.

5. A wall as claimed in claim 2, characterized in that the profile plate of said first skin comprises a first side which includes said first one of said inwardly directed noses having an edge with an inwardly bent strip which extends parallel to the plate, said plate is provided on a second side located opposite the first side with a second one of said inwardly directed noses, the depth of said second one of said noses is substantially the same as the depth of said first one of said noses, and said second one of said noses is provided with a second bent strip which extends parallel to the plate and which is directed outwardly.

6. A wall as claimed in claim 2, characterized in that the material strip is manufactured from mineral wool.

7. A wall as claimed in claim 1, characterized in that the material strip is manufactured from the same material as the insulating material arranged between said skins but that the density thereof is greater.

8. A wall as claimed in claim 7, characterized in that the connectors are screw connectors.

9. A wall as claimed in claim 7, characterized in that the profile plate of said first skin comprises a first side which includes said first one of said inwardly directed noses having an edge with an inwardly bent strip which extends parallel to the plate, said plate is provided on a second side located opposite the first side with a second one of said inwardly directed noses, the depth of said second one of said noses is substantially the same as the depth of said first one of said noses, and said second one of said noses is provided with a second bent strip which extends parallel to the plate and which is directed outwardly.

10. A wall as claimed in claim 7, characterized in that the material strip is manufactured from mineral wool.

11. A wall as claimed in claim 1, characterized in that the connectors are screw connectors.

12. A wall as claimed in claim 11, characterized in that the profile plate of said first skin comprises a first side which includes said first one of said inwardly directed noses having an edge with an inwardly bent strip which extends parallel to the plate, said plate is provided on a second side located opposite the first side with a second one of said inwardly directed noses, the depth of said second one of said noses is substantially the same as the depth of said first one of said noses, and said second one of said noses is provided with a second bent strip which extends parallel to the plate and which is directed outwardly.

13. A wall as claimed in claim 11, characterized in that the material strip is manufactured from mineral wool.

14. A wall as claimed in claim 1, characterized in that the profile plate of said first skin comprises a first side which includes said first one of said inwardly directed noses having an edge with an inwardly bent strip which extends parallel to the plate, said plate is provided on a second side located opposite the first side with a second one of said inwardly directed noses, the depth of said second one of said noses is substantially the same as the depth of said first one of said noses, and said second one of said noses is provided with a second bent strip which extends parallel to the plate and which is directed outwardly.

15. A wall as claimed in claim 14, characterized in that said insulating material between said first and second skins substantially takes the form of a parallelepiped and is positioned in a rebate formed by said first one of said noses and said second skin.

16. A wall as claimed in claim 1, characterized in that the material strip is manufactured from mineral wool.

17. A wall as claimed in claim 16, characterized in that the main direction of the fibres in the material strip is parallel to a main plane of the wall.

18. The wall as claimed in claim 1, wherein said wall includes an additional profile plate with a plurality of spaced noses, said additional profile plate is positioned adjacent said at least one profile plate so that one of said noses of said at least one profile plate overlaps one of said noses of said additional profile plate.

19. The walls as claimed in claim 18 wherein one of said pointed connectors extends between the overlapped noses.

* * * * *